US011466964B2

(12) United States Patent
Nuss et al.

(10) Patent No.: US 11,466,964 B2
(45) Date of Patent: Oct. 11, 2022

(54) BALLISTIC SHIELD APPARATUS

(71) Applicant: The Spark Project LLC, Hilliard, OH (US)

(72) Inventors: Elizabeth A. Nuss, Hilliard, OH (US); Steven Andrew Sauer, Columbus, OH (US)

(73) Assignee: THE SPARK PROJECT LLC, Hilliard, OH (US)

( * ) Notice: Subject to any disclaimer, the term of this patent is extended or adjusted under 35 U.S.C. 154(b) by 0 days.

(21) Appl. No.: 17/068,055

(22) Filed: Oct. 12, 2020

(65) Prior Publication Data

US 2021/0116218 A1 Apr. 22, 2021

Related U.S. Application Data

(60) Provisional application No. 62/924,301, filed on Oct. 22, 2019.

(51) Int. Cl.
*F41H 5/08* (2006.01)
*B65D 75/58* (2006.01)

(52) U.S. Cl.
CPC ..... *F41H 5/08* (2013.01); *B65D 75/5888* (2013.01)

(58) Field of Classification Search
CPC ..... F41H 5/08; F41H 5/06
See application file for complete search history.

(56) References Cited

U.S. PATENT DOCUMENTS 4,546,863 A 10/1985 Kaufman
4,919,037 A 4/1990 Mitchell
5,554,816 A 9/1996 Skaggs et al.
5,671,951 A 9/1997 Palmiter et al.
5,829,653 A 11/1998 Kaiser
6,161,738 A 12/2000 Norris
6,672,622 B2 1/2004 Barron
6,685,071 B2 2/2004 Prather
7,736,012 B1 6/2010 Chu et al.
8,579,367 B2 11/2013 Peters et al.
9,726,458 B2 8/2017 Weekly
9,737,100 B2 8/2017 McIntire, Jr.
10,634,463 B1 * 4/2020 DeAngeles ..... F41H 5/08
2005/0053769 A1 3/2005 Imblum et al.
2007/0295772 A1 12/2007 Woodmansee
2011/0097021 A1 4/2011 Curran et al.
2012/0051572 A1 * 3/2012 Graber ..... F41H 5/08 381/334
2012/0266344 A1 10/2012 Griffin
2016/0187106 A1 6/2016 Roberts et al.
2016/0290770 A1 * 10/2016 Martinez ..... F41H 5/08
2017/0307337 A1 10/2017 Boyd
(Continued)

OTHER PUBLICATIONS

BulletBlocker NIH IIIA NIJ III Bulletproof Inserts and Panels, https://www.bulletblocker.com/bullet-proof-inserts-panels-and-shields.html, date accessed Oct. 8, 2021.

(Continued)

*Primary Examiner* — J. Woodrow Eldred

(74) *Attorney, Agent, or Firm* — Benesch, Friedlander, Coplan & Aronoff LLP

(57) ABSTRACT

A ballistic shield has a front side and a rear side. A handle is supported on the rear side of the shield. A tear-away cover conceals the handle at the rear side of the shield, whereby the handle becomes accessible for use by tearing away the cover.

11 Claims, 12 Drawing Sheets

(56) References Cited

U.S. PATENT DOCUMENTS

2018/0372455 A1* 12/2018 Klassen ..... F41H 5/013
2021/0270574 A1* 9/2021 Bopp ..... F41H 5/08

OTHER PUBLICATIONS

Protect Your Family with Bulletproof Bag Inserts, https://hardwirellc.com/pages/bag-inserts, date accessed Oct. 8, 2021.
CNAS Test Report for Tuffy Packs, LLC Ballistic Panel, dated Aug. 10, 2016.

* cited by examiner

BALLISTIC SHIELD APPARATUS

RELATED APPLICATIONS

This application claims priority of provisional U.S. Patent Application 62/924,301, filed Oct. 22, 2019, which is incorporated by reference.

TECHNICAL FIELD

This technology includes ballistic shields for personal protection.

BACKGROUND

A ballistic shield for personal protection may be configured for a person to carry and deploy by the use of handles at the rear side of the shield.

SUMMARY

In a given example, a ballistic shield has a front side and a rear side. A handle is supported on the rear side of the shield. A tear-away cover conceals the handle at the rear side of the shield, whereby the handle becomes accessible for use by tearing away the cover.

The cover may enclose the shield, and may include means for rupturing at a predetermined location under stress applied manually. For example, the cover may be formed of paper, and the means for rupturing may comprise a frangible portion of the cover.

Summarized differently, a ballistic shield has a front side, a rear side, and an elongated rectangular periphery with left and right side edges reaching longitudinally between upper and lower end edges. A pair of handles are supported on the rear side of the shield in positions longitudinally offset from one another. The shield further has a transverse centerline, and each handle is anchored to the shield on only one side of the transverse centerline.

A fabric panel overlies the rear side of the shield. The panel has a pair of slits defining a strap with a width reaching between the slits and a length reaching alongside the slits. The strap is thus configured as a handle for a user to grasp with fingers reaching through the slits.

In the given examples, the fabric panel has a pair of edge portions reaching alongside the slits. The strap overlies the rear side of the shield in a nominal position substantially coplanar with the edge portions of the panel. A fabric flap reaches across the width of the strap between the strap and the rear side of the shield.

In another embodiment, an apparatus includes a ballistic shield having a front side and a rear side, with a pair of handles supported on the rear side of the shield, and a cover enclosing the front and rear sides of the shield. The cover has openings providing manual access to the handles at the rear side of the shield. The cover also has flaps reaching across the openings.

DETAILED DESCRIPTION

Figure 1:
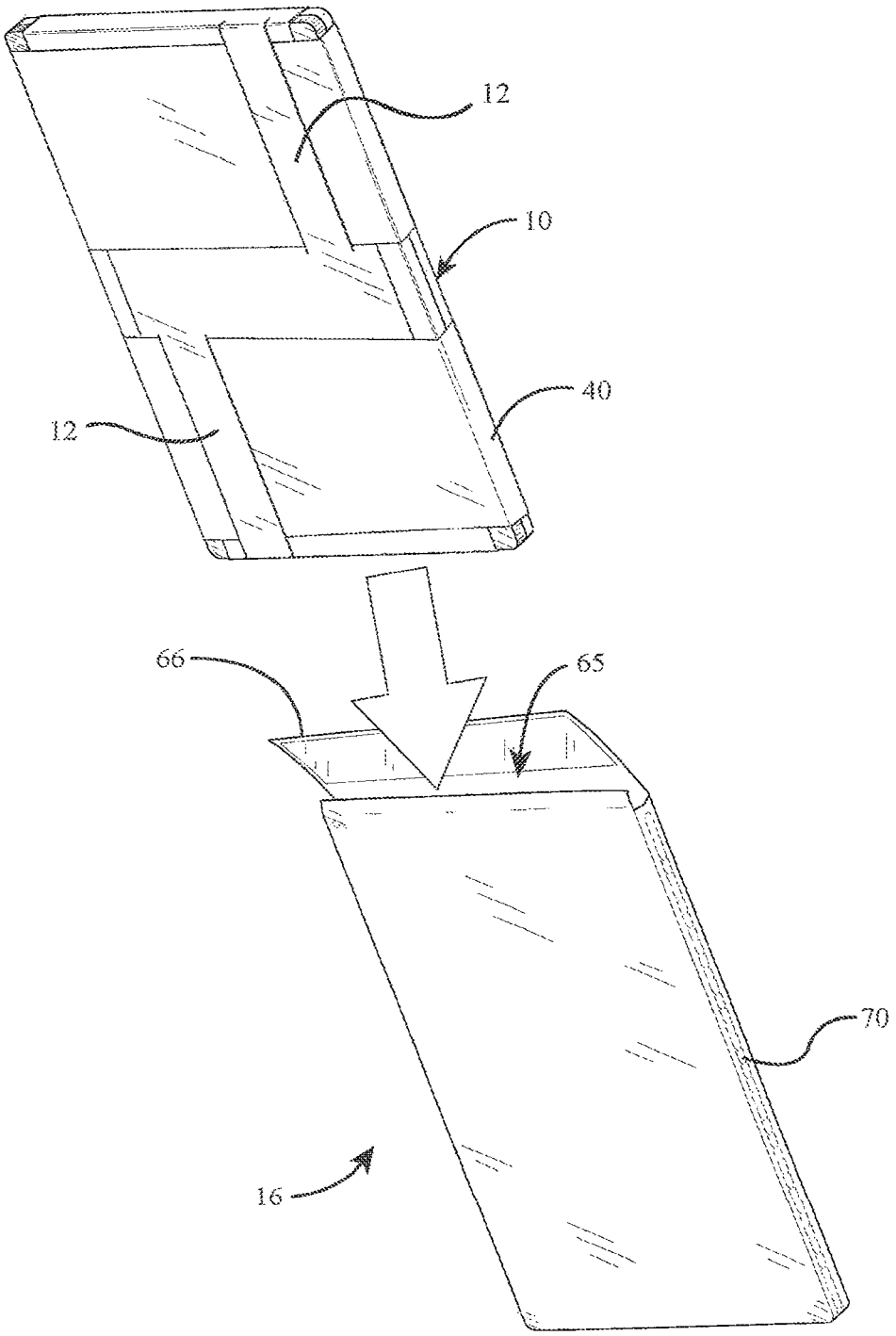
FIG. 1 is perspective view of a ballistic shield and a cover for the shield.

The apparatus illustrated in the drawings has parts that are examples of the elements recited in the claims. The illustrated apparatus thus includes examples of how a person of ordinary skill in the art can make and use the claimed invention. They are described here to provide enablement and best mode without imposing limitations that are not recited in the claims. One or more elements of one embodiment may be used in combination with, or as a substitute for, one or more elements of another as needed for any particular implementation of the claimed invention.

The apparatus shown in FIG. 1 includes a ballistic shield 10 with handles 12. Also shown is a tear-away cover 16 for the shield 10 and handles 12.

Figure 2:
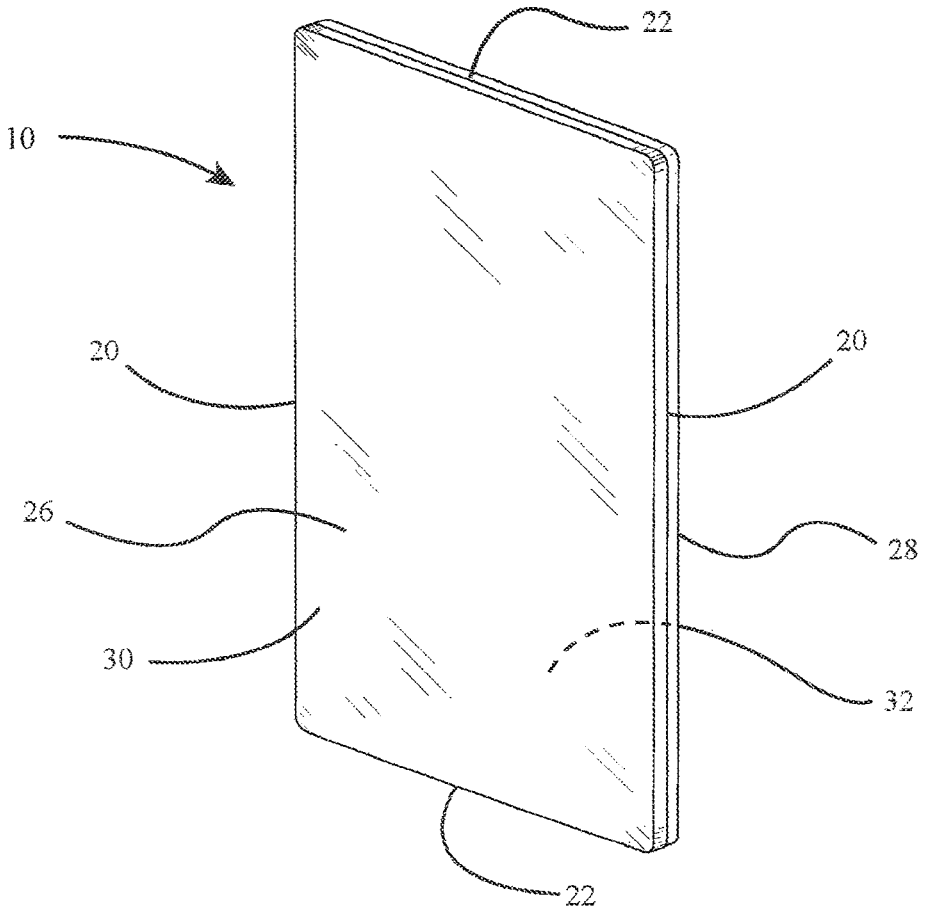
FIG. 2 is a perspective view of the shield of FIG. 1.

As shown separately in FIG. 2, the shield 10 in the illustrated example is a flat rectangular panel with opposite side edges 20 reaching longitudinally between opposite end edges 22. A first layer 26 of the shield 10 is formed of ballistic armor material such as, for example, a rigid composite material. A second layer 28 of the shield 10 is formed of a spall protection material such as, for example, a deflectable foam material. The first layer 26 defines a front side 30 of the shield 10, and the second layer 28 defines a rear side 32 of the shield 10.

Figure 3:
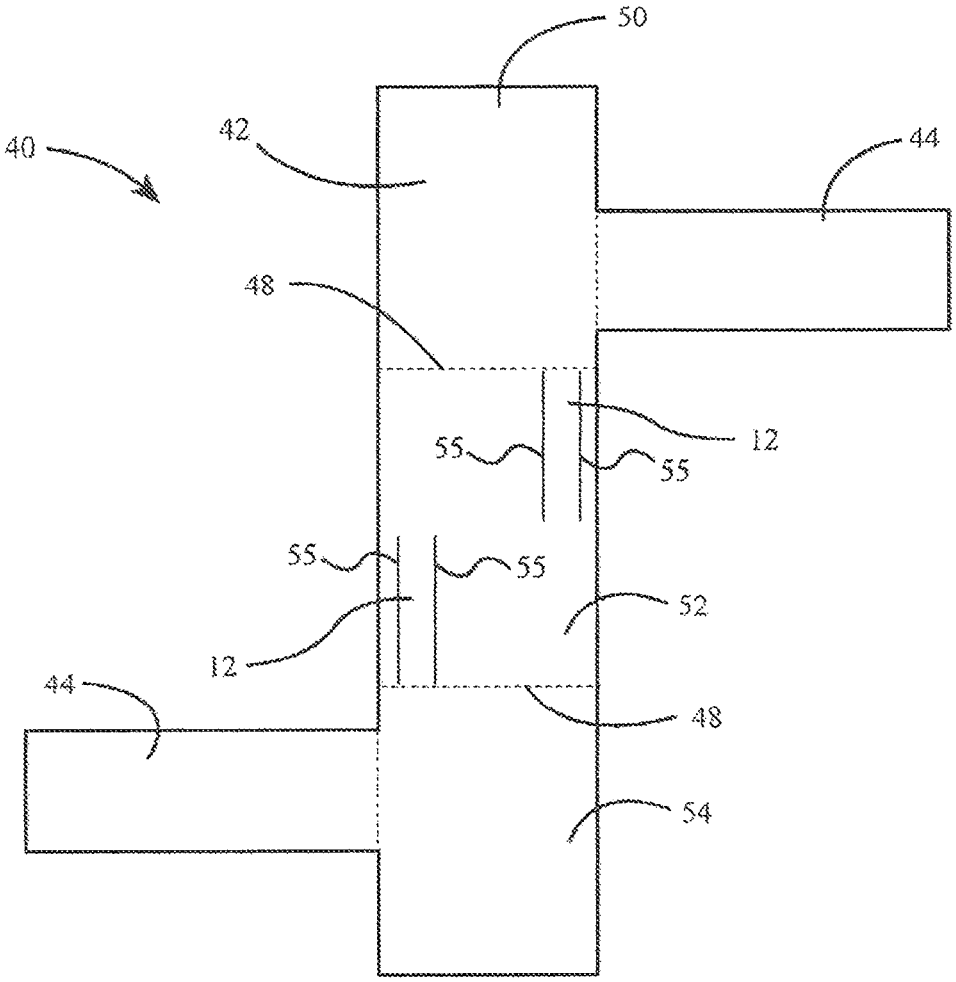
FIG. 3 is a plan view of a fabric panel for folding and wrapping around the shield.

The handles 12 in the illustrated example are integral parts of a unitary panel of fabric 40 that is wrapped around the shield 10. As shown separately in FIG. 3, the fabric 40 has a rectangular body portion 42 with a pair of flaps 44 projecting laterally from the body portion 42. Fold lines 48 divide the body portion 42 into three sections 50, 52, and 54 of equal length.

Two pairs of slits 55 are formed in the body portion 42 of the fabric 40. The slits 55 in each pair are parallel and of equal length. One of the handles 12 is defined by a strap-shaped portion of the fabric 40 between one pair of slits 55, and the other handle 12 is likewise defined by a strap-shaped portion of the fabric 40 between the other pair of slits 55. Each handle 12 thus has a nominal position substantially coplanar with adjacent edge portions of the fabric alongside the slits 55, and with a width reaching between the corresponding slits 55 and a length reaching alongside the corresponding slits 55.

Figure 4:
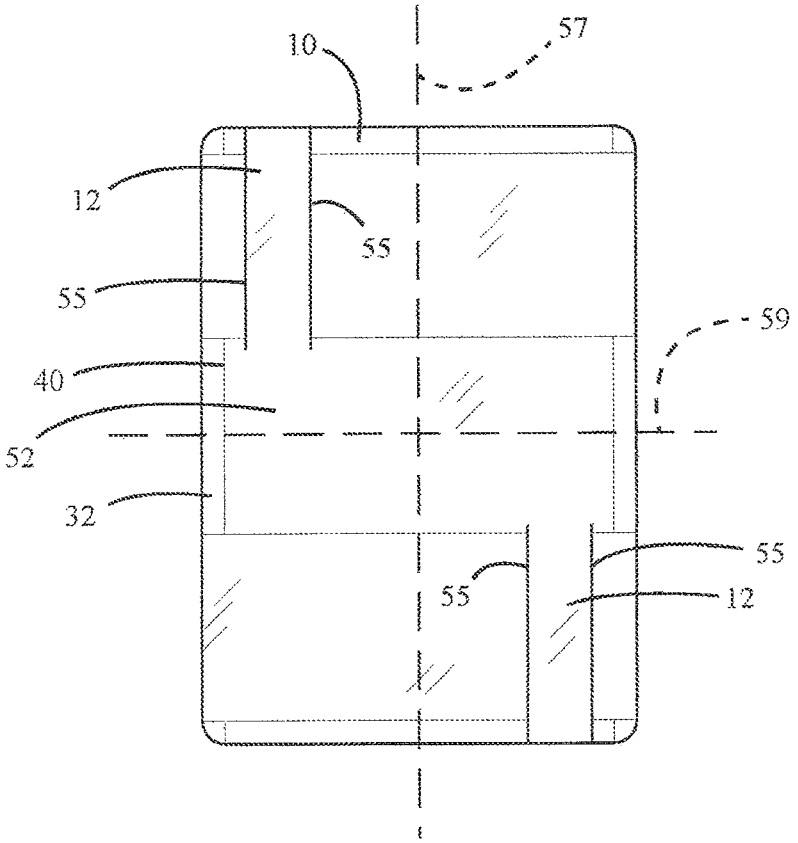
FIG. 4 is a rear view of the shield with the fabric wrapped around the shield.
Figure 5:
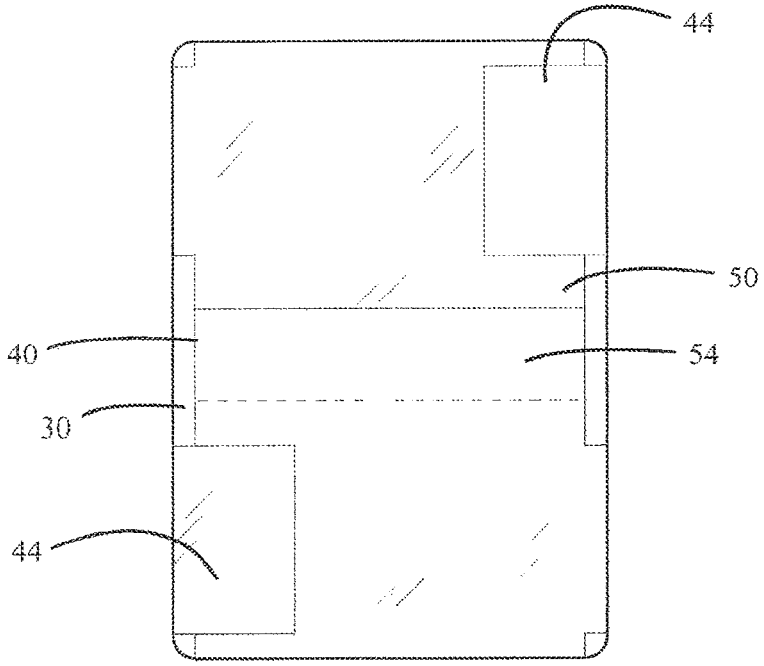
FIG. 5 is a front view of the shield with the fabric wrapped around the shield.
Figure 6:
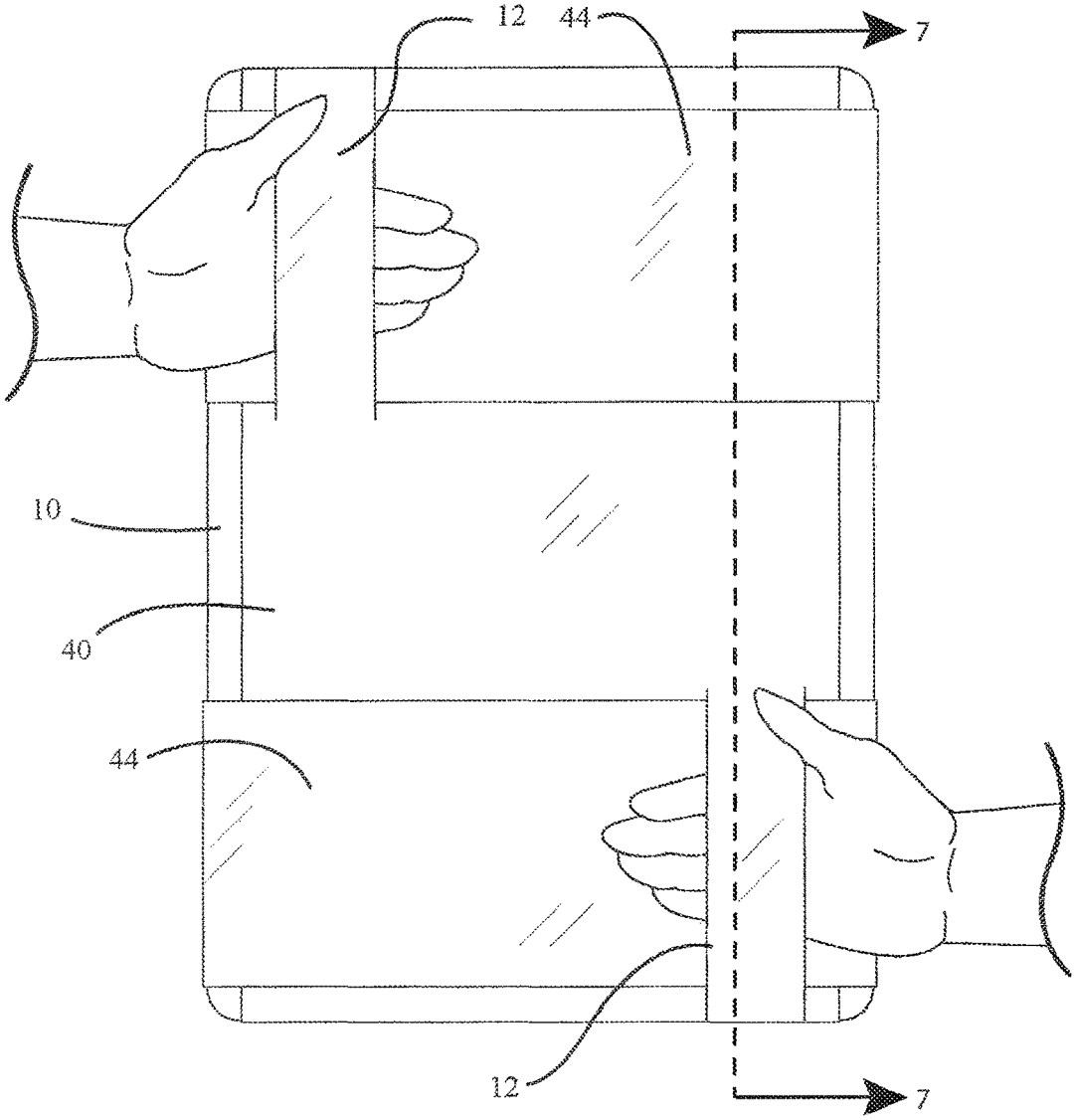
FIG. 6 is a view similar to FIG. 4, showing a user's hands grasping handles at the rear of the shield.
Figure 7:
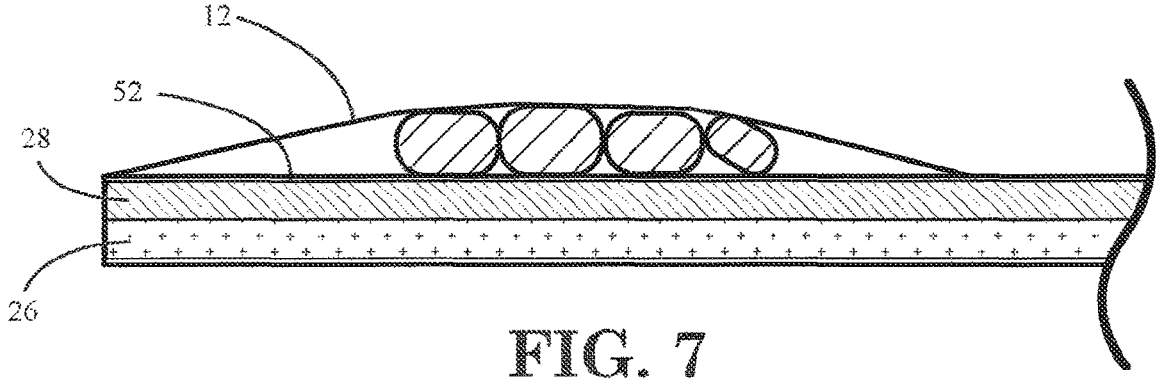
FIG. 7 is a schematic view taken on line 7-7 of FIG. 6.

The body portion 42 and the flaps 44 together provide the fabric 40 with a configuration for folding and wrapping around the shield 10 as shown in FIGS. 4 and 5. Specifically, the central section 52 of the body portion 42 overlies the rear side 32 of the shield 10 as shown in FIG. 4. The end sections 50 and 54 of the body portion 42 are folded over the end edges 22 of the shield, and overlie the front side 30 of the shield 10 as shown in FIG. 5. The flaps 44 are folded around the side edges 20 of the shield 10 to reach from the front side 30 to the rear side 32, fully across the rear side 32, and further back around to the front side 30. Each flap 44 at the rear side 32 of the shield 10 is passed through the slits 55 at a corresponding handle 12 to reach across the corresponding handle 12 as shown in FIG. 4. The flaps 44 are thus interposed between handles 12 and the shield 10 to provide fabric surfaces where the user's fingers can slide behind the handles 12 and pull the handles 12 backward away from the their nominal positions so as to grasp the handles 12, as shown in FIGS. 6-7.

As further shown in FIG. 4, the shield 10 has a longitudinal centerline 57 and a transverse centerline 59. The handles 12 are offset from one another on opposite sides of the longitudinal centerline 57. Each handle 12 is located on only one side of the transverse centerline 59.

Referring again to FIG. 1, the cover 16 in the illustrated example is an envelope with an opening 65 at one end. A closure flap 66 at the opening 65 has a removable film 68 over an adhesive for securing the flap 66 in a closed position. The cover 16 is sized and shaped for the shield 10 and the fabric 40 to be inserted through the opening 65 and enclosed closely within the cover 16.

Figure 8:
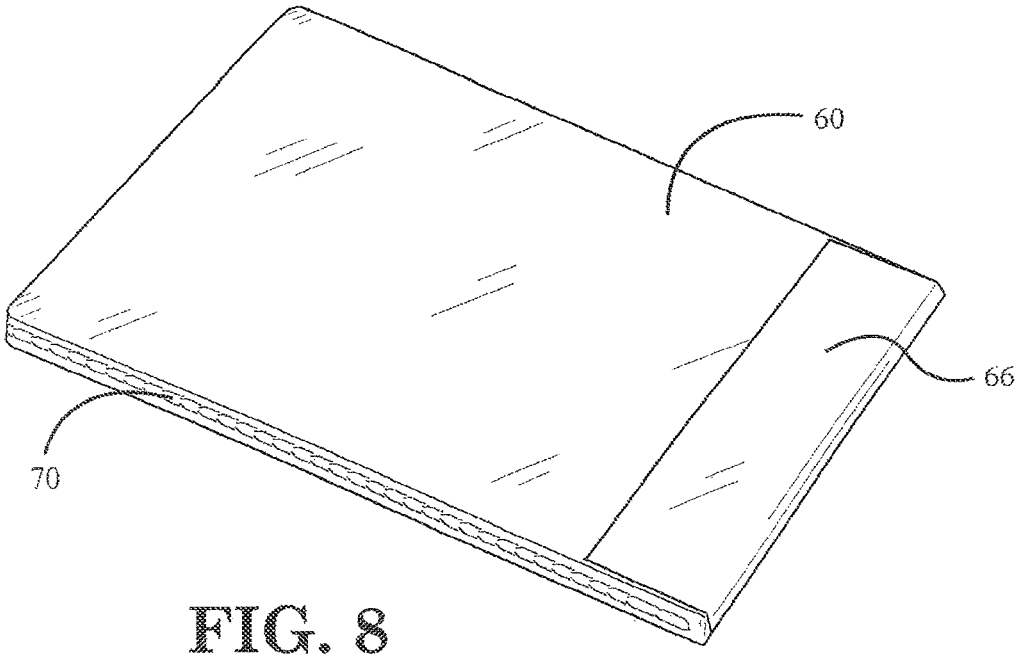
FIG. 8 is a perspective view of the cover containing the shield.
Figure 9:
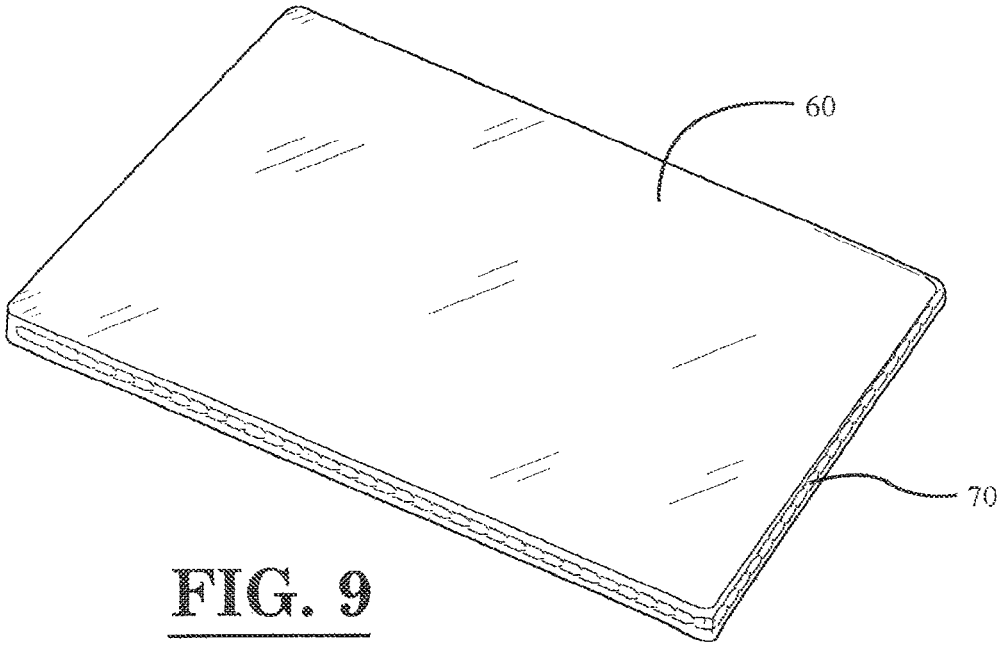
FIG. 9 is a view similar to FIG. 8, take from an opposite side.
Figure 10:
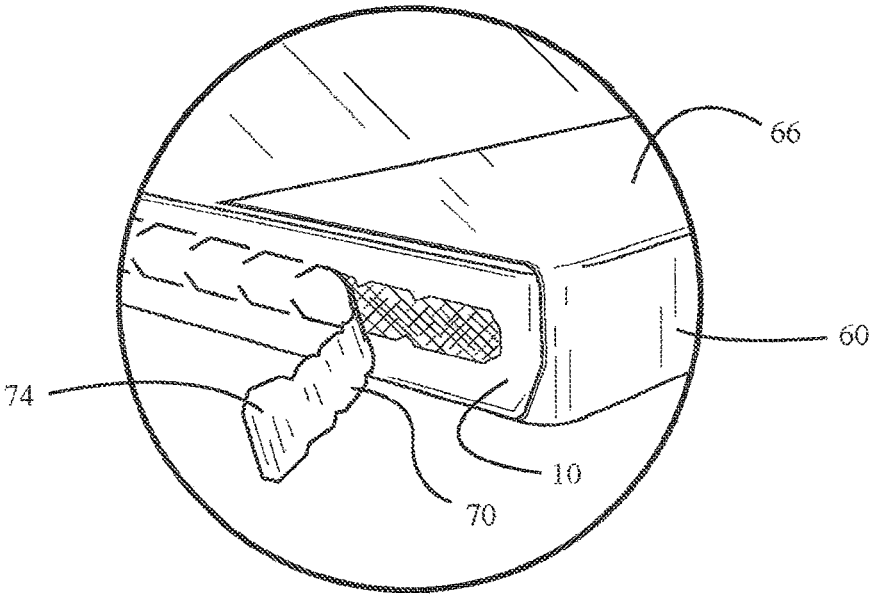
FIG. 10 is an enlarged partial view of the shield and cover of FIG. 8.
Figure 11:
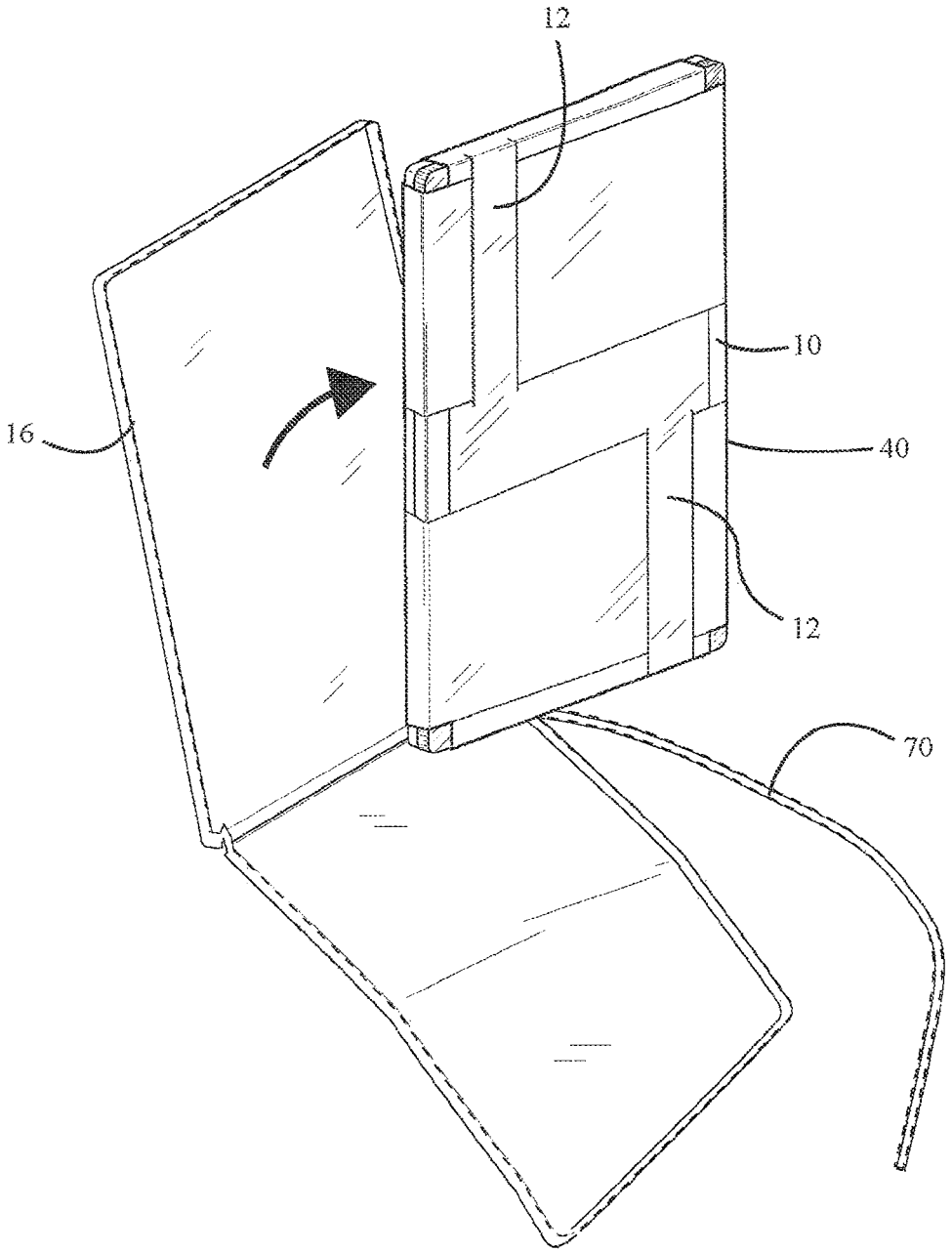
FIG. 11 is a perspective view of the shield with the cover in an opened condition.

The cover 16 is provided with means for rupturing under stress applied manually by the user. This includes a frangible portion of the cover in the form of a tear-away strip 70. The tear-away strip 70 reaches along three side edges of the cover 16 as shown in FIGS. 1 and 8-9. A pull tab 74 on the strip 70 enables the user to easily tear the strip 70 away manually, as shown in FIG. 10, to open the cover 16 as shown in FIG. 11. This releases the shield 10 and handles 12 for use in deflecting ballistic projectiles.

The cover 16 may be formed of any suitable material that is easily rupturable manually to provide ready access to the handles 12. Such materials may include paper, paperboard, vinyl, and the like. Although the illustrated embodiment has a means for rupturing at the predetermined location of the tear-away strip 70, the cover 16 may be formed partially or entirely of light paper or other material than can be easily broken and torn away at one or more random locations on the cover 16.

In alternative embodiment, the shield 10 can be provided with a spall resistant material on both the front side and the rear side, and the fabric 40 can be configured with an additional pair of handles for placement at the front side of the shield 10. In each case, the overlapping portions of the fabric 40 may be adhered together as needed to maintain the wrapped configuration of the fabric 40 on the shield 10.

Figure 12:
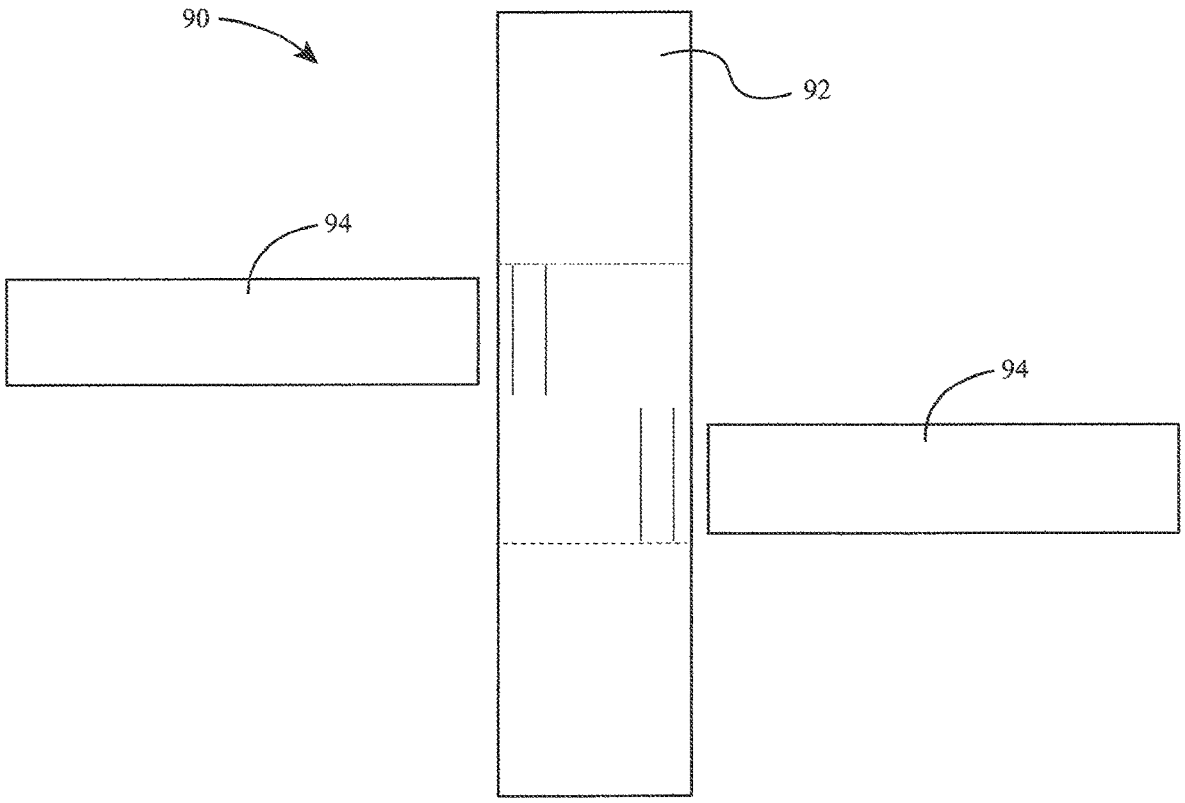
FIG. 12 is a plan view of an alternative embodiment of the fabric panel of FIG. 3.

As shown in FIG. 12, a multi-piece fabric wrap 90 may be provided in place of the unitary fabric panel 40. The fabric wrap 90 has a rectangular body portion part 92 a pair of flap portions 94 that are provided as separate pieces of fabric to be sewn together, but is otherwise substantially the same as the fabric panel 40.

Figure 13:
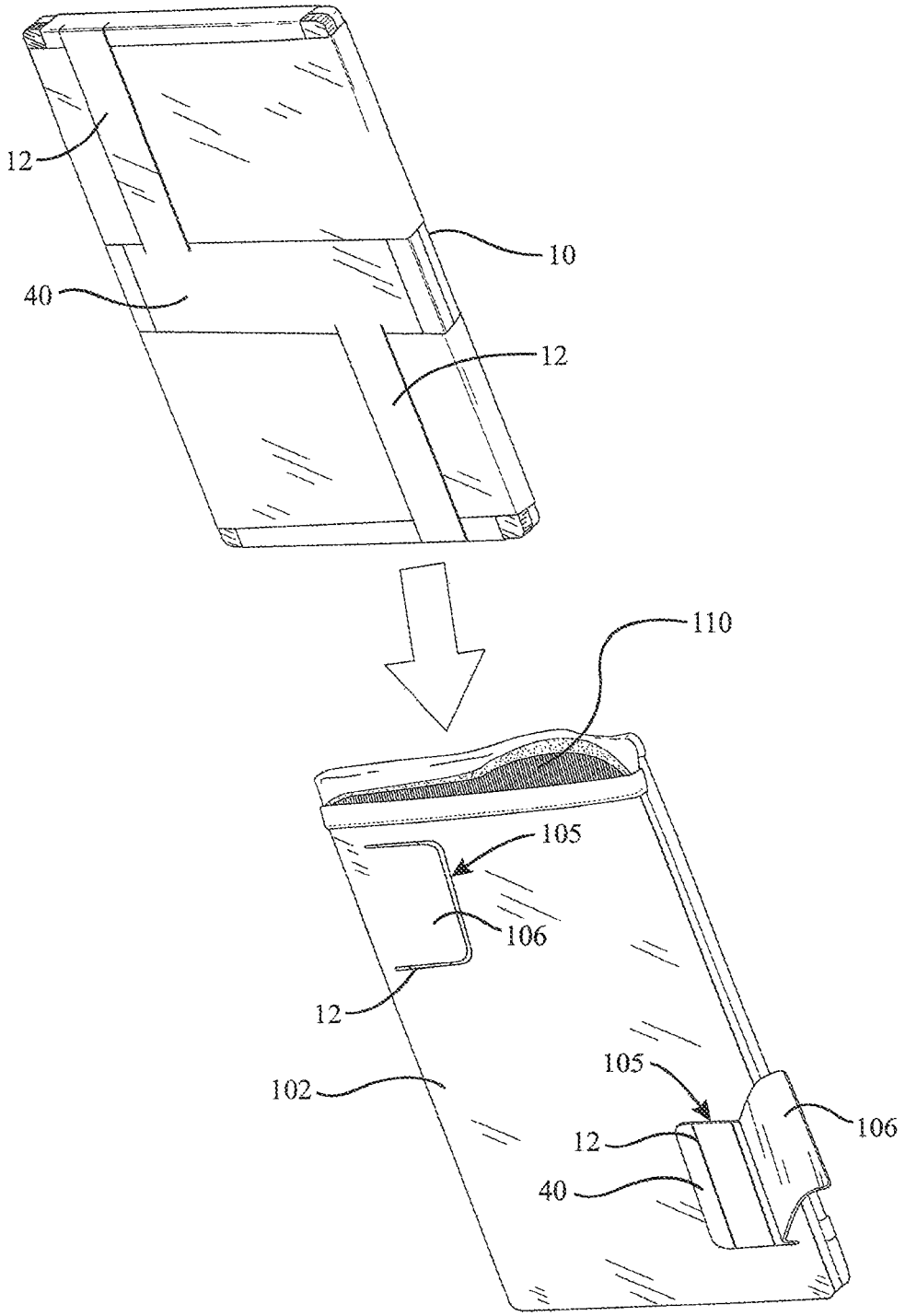
FIG. 13 is a perspective view of the shield 10 with an alternative embodiment of a cover for the shield.
Figure 14:
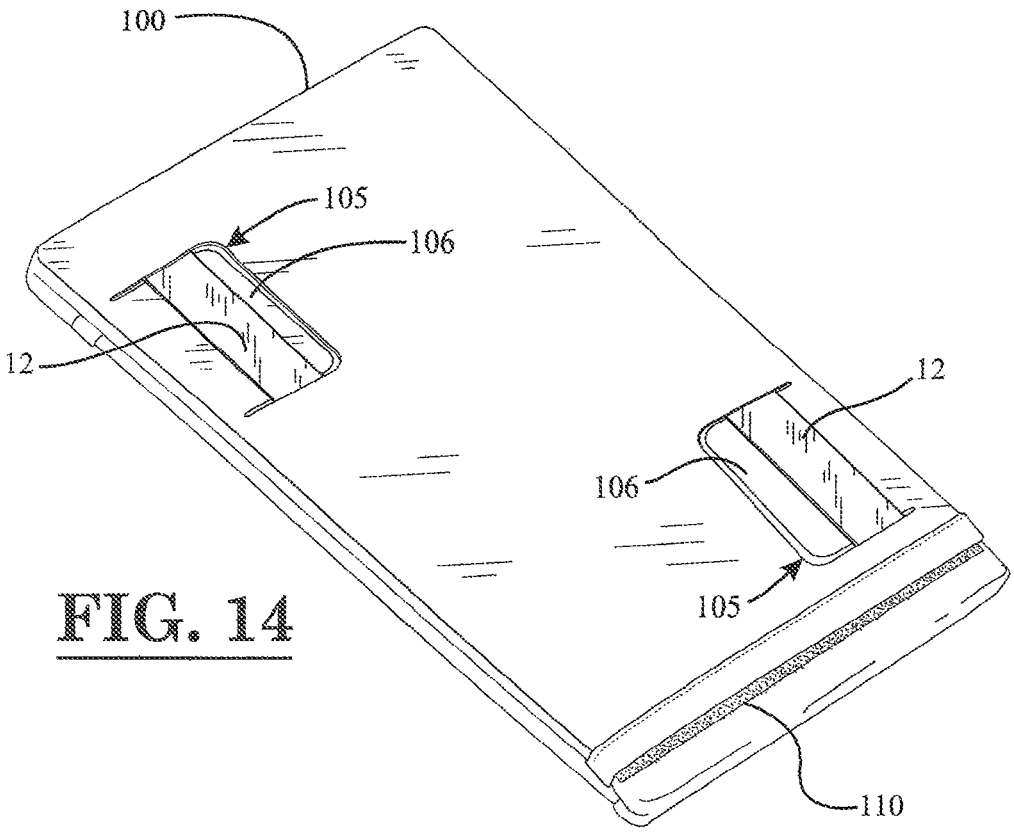
FIG. 14 is a perspective view of the cover of FIG. 13, taken from the rear.
Figure 15:
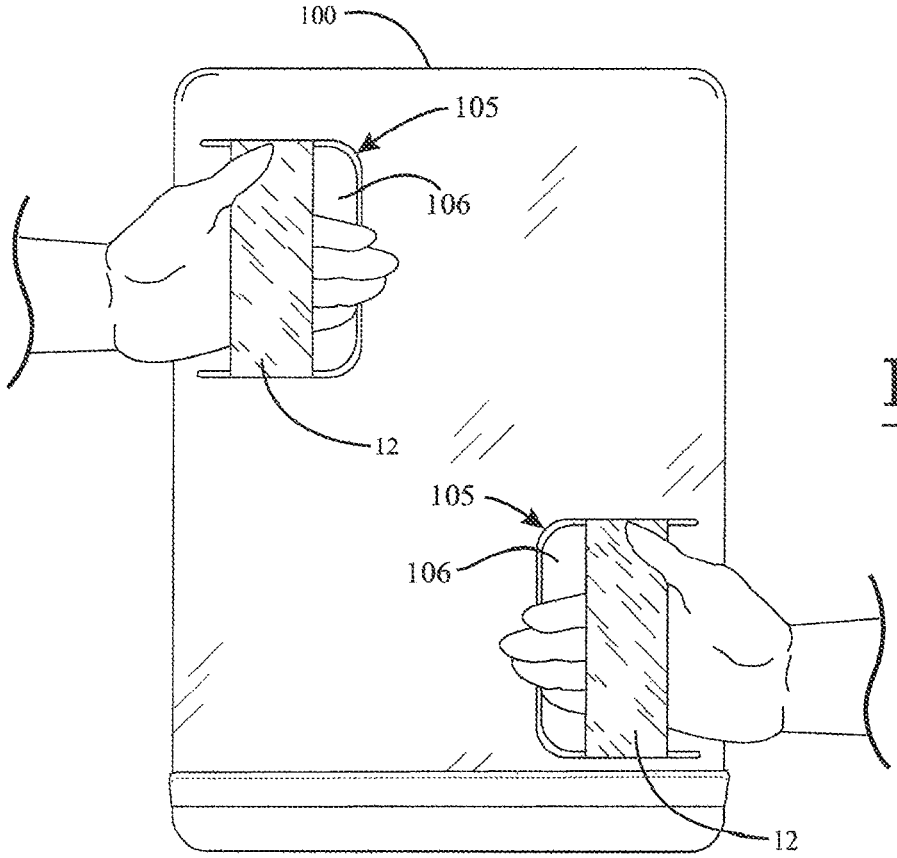
FIG. 15 is a rear view of the cover of FIG. 13.

An alternative cover 100 may be provided in place of the cover 16, as shown in FIG. 13. Like the cover 16 described above, the cover 100 is an envelope configured to closely enclose the shield 10 and the fabric 40. However, unlike the cover 16, the cover 100 is not configured to be torn away from the shield 10 and fabric 40 to provide access to the handles 12. Instead, the cover 100 has a rear side 102 with openings 105 that are sized, shaped, and located to provide access to the handles 12 without the need to remove the cover 100 from the shield 10 and fabric 40. Flaps 106 on the cover 100 are sized to reach across the openings 105, either behind the handles 12 as shown in FIG. 13, or tucked in front of the handles 12, as shown in FIGS. 14 and 15.

Figure 16:
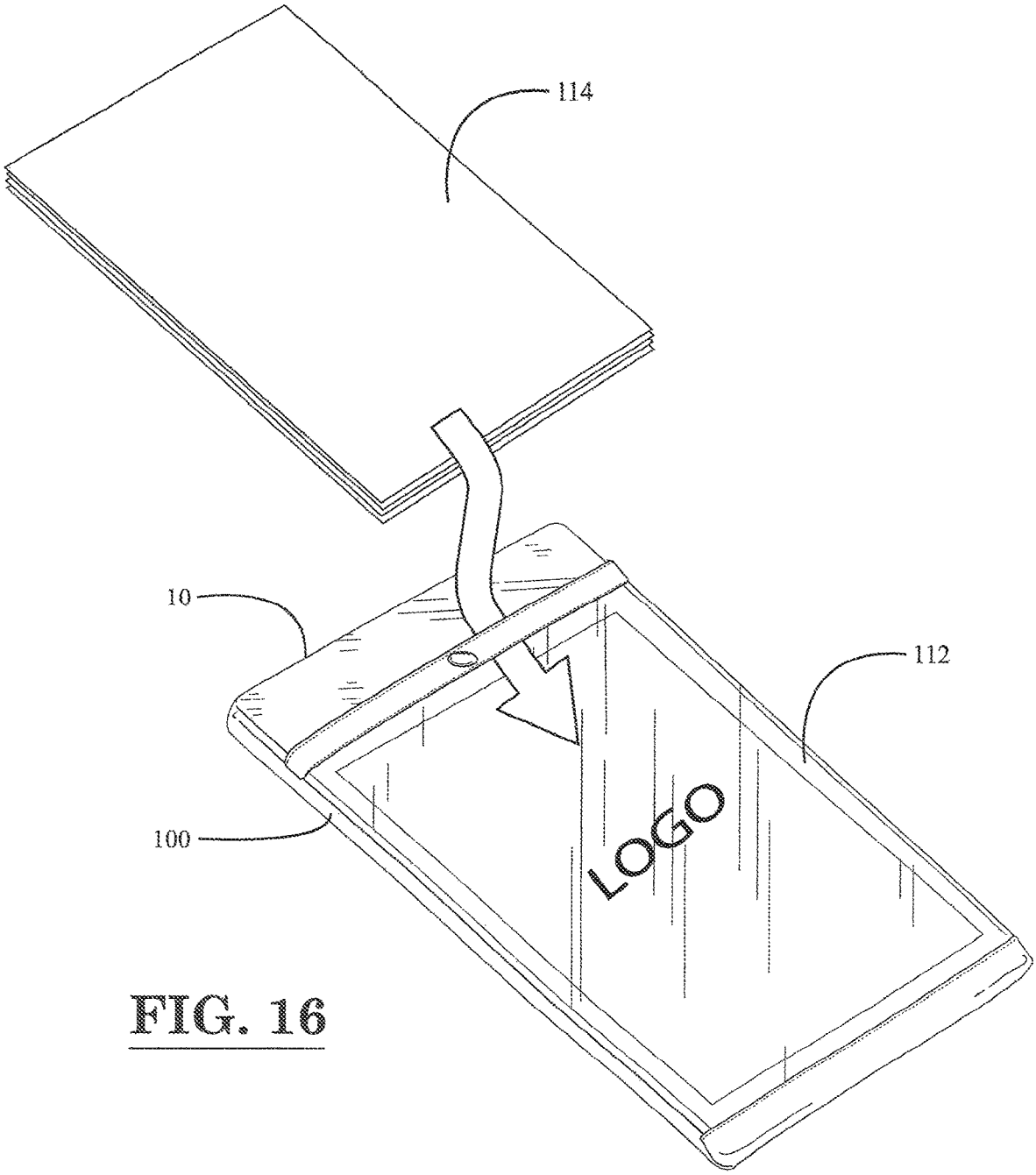
FIG. 16 is a perspective view of the cover of FIG. 13, taken from the front.

The open end 108 of the cover 100 can be closed by hook and loop fasteners 110 (FIGS. 13, 14) or any other suitable closure means. As shown in FIG. 16, the cover 100 may have a transparent front side 112 for the display of paper or other graphic material for decorating or personalizing the entire package to avoid a conspicuous appearance of a ballistic shielding device.

This written description sets for the best mode of carrying out the invention, and describes the invention so as to enable a person of ordinary skill in the art to make and use the invention, by presenting examples of the elements recited in the claims. The detailed descriptions of those elements do not impose limitations that are not recited in the claims, either literally or under the doctrine of equivalents.

The invention claimed is:

1. An apparatus comprising:

a ballistic shield having a front side and a rear side;

a pair of handles supported on the rear side of the ballistic shield; and a cover enclosing the front and rear sides of the ballistic shield, wherein the cover has openings providing manual access to the handles at the rear side of the ballistic shield, wherein the cover has flaps reaching across the openings.

2. An apparatus as defined in claim 1, further comprising a fabric panel overlying the rear side of the ballistic shield, the fabric panel includes straps defining the handles, and the flaps on the cover are configured to reach across the straps.

3. An apparatus as defined in claim 2, wherein the flaps on the cover are configured to reach across the straps between the straps and the ballistic shield.

4. An apparatus as defined in claim 1, wherein the ballistic shield has an elongated rectangular periphery with left and right side edges reaching longitudinally between upper and lower end edges, and the handles are supported on the rear side of the ballistic shield in positions longitudinally offset from one another.

5. An apparatus as defined in claim 4, wherein the ballistic shield has a transverse centerline, and each handle is anchored to the ballistic shield on only one side of the transverse centerline.

6. An apparatus as defined in claim 1, wherein the cover has a front side and the front side is transparent.

7. An apparatus comprising:

a ballistic shield having a front side and a rear side;

a fabric panel wrapped around the ballistic shield, the fabric panel including straps defining a pair of handles on the rear side of the ballistic shield; and a cover enclosing the front and rear sides of the ballistic shield, wherein the cover has openings providing manual access to the straps at the rear side of the ballistic shield, wherein the cover has flaps reaching across the openings.

8. An apparatus as defined in claim 7, wherein the flaps on the cover are configured to reach across the straps between the straps and the ballistic shield.

9. An apparatus as defined in claim 7, wherein the ballistic shield has an elongated rectangular periphery with left and right side edges reaching longitudinally between upper and lower end edges, and the handles are supported on the rear side of the ballistic shield in positions longitudinally offset from one another.

10. An apparatus as defined in claim 9, wherein the ballistic shield has a transverse centerline, and each handle is anchored to the ballistic shield on only one side of the transverse centerline.

11. An apparatus as defined in claim 7, wherein the cover has a front side and the front side is transparent.

* * * * *